United States Patent [19]

Shinohara et al.

[11] 4,218,499

[45] Aug. 19, 1980

[54] METHOD OF FIXING HEAT-FUSIBLE TONER IMAGES FORMED ON A WEB

[75] Inventors: Yukimasa Shinohara, Yokohama; Hiroo Ichihashi, Tokyo, both of Japan

[73] Assignee: Canon Kabushiki Kaisha, Tokyo, Japan

[21] Appl. No.: 819,141

[22] Filed: Jul. 26, 1977

[30] Foreign Application Priority Data

Jul. 30, 1976 [JP] Japan ..... 51-91834

[51] Int. Cl.[2] ..... G03G 15/20

[52] U.S. Cl. ..... 427/444; 427/194; 118/60; 432/60; 355/3 FU; 219/216; 430/124

[58] Field of Search ..... 427/22, 194, 444; 432/60; 219/216; 355/3 FU; 118/60

[56] References Cited

U.S. PATENT DOCUMENTS

| | | | |
|---|---|---|---|
| 3,268,351 | 8/1966 | Van Dorn | 427/444 |
| 3,349,702 | 10/1967 | Nesin et al. | 101/416 R |
| 3,667,742 | 6/1972 | Kamola | 432/60 |
| 3,825,724 | 7/1974 | Kingsley et al. | 219/216 |
| 3,851,144 | 11/1974 | Hutner | 219/216 |
| 3,861,863 | 1/1975 | Kudsi | 432/60 |
| 3,936,658 | 2/1976 | Traister | 219/216 |

*Primary Examiner*—Ralph S. Kendall

*Attorney, Agent, or Firm*—Fitzpatrick, Cella, Harper & Scinto

[57] ABSTRACT

A method of fixing toner images carried on a long footage of continuous web such as rolled paper or folded paper, uniformly but intermittently from end to end of the web. During fixation, the image bearing surface of the web is urged against a fixing member such as heated roller or the like and the fixing member is rotated to move the web, and during the intermission of fixation, the web is disengaged from the fixing member. Preferably, when the web is urged against the fixing member and/or when the web is disengaged from the fixing member, rotation of the fixing member is stopped and the web is maintained in pressure contact with the fixing member as it is stopped from rotating.

10 Claims, 13 Drawing Figures

METHOD OF FIXING HEAT-FUSIBLE TONER IMAGES FORMED ON A WEB

BACKGROUND OF THE INVENTION

1. Field of the Invention

This invention relates to a method of fixing heat-fusible toner images formed on a web by bringing the images into contact with a heated rotatable fixing member.

2. Description of the Prior Art

For example, in the field of electrophotography, an electrostatic latent image formed on a photosensitive medium is developed with toner particles electrically charged to the opposite polarity from that of the latent image. The toner image so formed is intactly fixed on the photosensitive medium or alternatively, it is first transferred from the photosensitive medium onto paper or synthetic resin sheet and then fixed thereon . For such fixation, heat is usually used. Generally, toner consists chiefly of heat-fusible synthetic resin which may be fused by heat and fixed on a toner image bearing member.

In general, there are two methods for fixing toner image on an image bearing member by heat. One of the methods comprises applying radiant heat both to the toner image and the image bearing member, and the other method comprises bringing the toner image and the image bearing member into direct contact with a heated fixing member. The former method is low in efficiency of heat utilization and accordingly requires a heat source of great output, which means low safety and bulkiness of the apparatus. Recently, therefore, the latter method has become dominant which is high both in efficiency of heat utilization and safety and which leads to a smaller size of the apparatus. Examples of this latter method are disclosed in U.S. Pat. No. 3,452,181, U.S. Pat. No. 3,539,161, U.S. Pat. No. 3,945,726, etc. Any of these methods comprises passing a toner image bearing member through the nip formed between a pair of rollers. At least one of the rollers, namely, that roller which is in contact with the toner image bearing surface of the image bearing member, is heated by a heat source provided outside or within the roller. The methods of fixation disclosed in these patents are suited for fixing toner images formed on short cut bearing members or cut sheets. More particularly, these methods are suited for treating a multiplicity of cut sheets bearing toner images thereon continuously or at intervals, whereas they are not suitable for intermittently fixing toner images formed on a long footage of web.

U.S. Pat. No. 3,268,351 and U.S. Pat. No. 3,667,742 disclose methods of fixing toner images formed on a long footage of web. The methods of these patents comprises bringing a heated roller or a heated endless belt into contact with the toner image bearing surface of the web. The roller or the belt is rotated as the web is fed. Again, these methods are not suitable for intermittently treating the long footage of web. The reason is that, as is also the case with the aforementioned method of fixation for cut sheets, a pair of rollers or endless belts are urged against the image bearing member whenever the image bearing member is present between the pair of rollers or endless belts. Therefore, when fixation is interrupted, that portion of the web which is contacted by the heated fixing member may be degenerated or scorched or burnt. Further, if a toner image was present on said portion, that image would be destroyed by the idle rotation of the fixing member which is in contact with the web or, if such rotation of the fixing member was stopped to avoid this, that image might be too much fused and hot-offset to the fixing member. To avoid these inconveniences, rotation of the fixing member may be stopped and the temperature thereof may be lowered when the feeding of the web is stopped or when the fixation is intermitted, but the temperature once lowered would require much time to recover and this would offer an obstacle when the fixation is to be resumed.

U.S. Pat. No. 3,349,702 discloses another method of fixing toner images on a long footage of web. According to this method, a roller divided into a hot portion and a cold portion is normally brought into contact with the web and during movement of the web, the roller is rotated so as to bring the hot portion thereof into contact with the web and when the web is stopped, the roller is rotated so as to bring the cold portion thereof into contact with the web. This method can avoid the above-mentioned scorching or burning of the web, but the roller being brought into contact with the non-image bearing surface of the web results in not so good efficiency of heat utilizaton. This is because heat transfers only through the web to the toner to be fused. This in turn leads to the requirement of a high output for the heat source, which might also degenerate the web. This drawback would become more serious as the web is thicker. To avoid such a disadvantage, it would occur to mind to bring the roller divided into the hot and the cold portion into contact with the toner image bearing surface of the web, but this would be impossible in practice, since it would result in entirely unfixed toner images. In order for the toner images not to be disturbed, the roller during movement of the web must needs be rotated at the same velocity as the linear velocity of the web, whereas this would in turn bring the hot and the cold portion of the roller alternately into contact with the toner bearing surface of the web.

SUMMARY OF THE INVENTION

It is a primary object of the present invention to provide an improved method of fixation whereby heat-fusible toner images formed on a long footage of web may be fixed intermittently.

It is another object of the present invention to provide a method of fixation of the described type and which is high in efficiency of heat utilization and enables images to be fixed with an excellent fusing effect.

It is still another object of the present invention to provide an improved method of fixation of the described type and which may be carried out without the web being adversely affected by heat during the intermission of fixation.

The method of fixation according to the present invention essentially comprises the steps of bringing the toner image bearing surface of a web into contact with a heated fixing member to fix toner images on the web, rotating the fixing member to feed the web, and bringing the web out of contact with the fixing member after a desired amount of the web has been fed. Thus, the present invention overcomes the above-noted disadvantages peculiar to the prior art methods and imparts no damage to the web during the intermission of fixation and in addition, enables images to be fixed on the web by efficient utilization of heat and with an excellent fusing effect.

According to the present invention, the web is brought out of contact with the fixing member when fixation is intermitted, and the web is again brought into contact with the fixing member when fixation is resumed. Both when the web is brought into contact with the fixing member and when the web is brought out of contact with the fixing member, that is, both at the point of time whereat fixation is started and the point of time whereat fixation is stopped, the fixing member, if it is still rotating, may cause irregularities in the fixed condition of toner image or partly disturb the toner image. This is because, in some cases, sufficient heat may not be imparted to the toner image at the moment when the toner image is brought into or out of contact with the rotating fixing member, and therefore the toner image may not become sufficiently fused to be fixed at these moments. Also, in such cases, the toner image may be cool-offset to the fixing member. Further, as unfixed toner image is brought into contact with the rotating fixing member, the toner image could be disturbed by a slip or mechanical stress or shock which would momentarily occur between the fixing member and the web.

To avoid such inconveniences, the fixing member should make contact with the non-image bearing portion of the web at the fixation starting time or at the fixation stopping time. However, this would greatly restrict the manner in which images are formed on the web.

Accordingly, it is a further object of the present invention to provide a method of fixation which is free of the disadvantages noted just above.

The invention will become more fully apparent from the following detailed description of some embodiments thereof taken in conjunction with the accompanying drawings.

DESCRIPTION OF THE PREFERRED EMBODIMENTS

Figure 1:
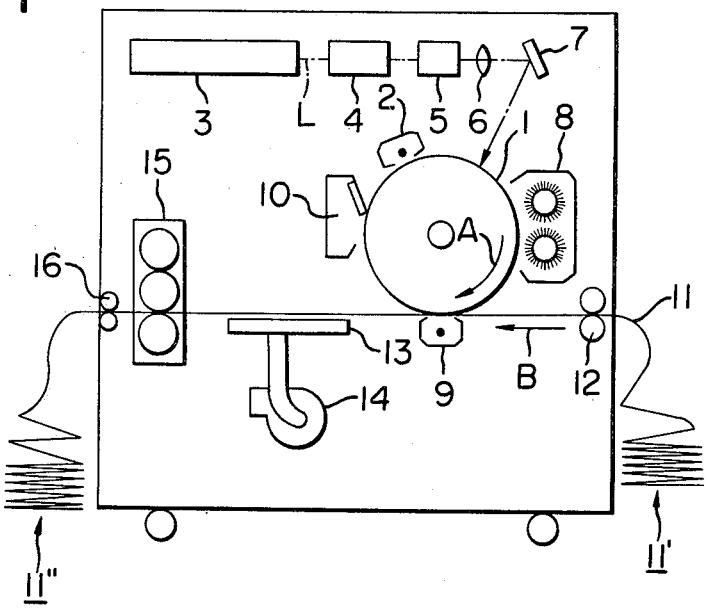
FIG. 1 schematically illustrates a print-out apparatus at the output of an electronic computer to which the present invention is applicable.

The apparatus shown in FIG. 1 is an output printer for an electronic computer to which the present invention is applied. A photosensitive drum 1 having a photoconductive layer on the peripheral surface thereof is rotatable in the direction of arrow A. A corona discharger 2 uniformly charges the peripheral surface of the drum 1 prior to exposure of the drum to light. Designated by 3 is a light source such as, for example, a laser, which emits a thin light beam L. Output signals generated from an unshown electronic computer are applied to a modulator 4, which intercepts or transmits the light beam L in accordance with said signals. The light beam L from the modulator 4 is converted into a light beam which scans angularly in a plane perpendicular to the plane of the drawing sheet, by a scanner 5 provided with a rotatable polygonal mirror. A lens 6 converts this light beam into a beam which scans parallel. Preferably, the lens 6 may be an $f-\theta$ lens for making the scanning velocity of the light beam uniform within the scanned area. A mirror 7 deflects this light beam to thereby direct it to the drum 1. Instead of the lens 6 and mirror 7, a concave mirror may be employed to deflect the light beam and cause it to scan parallel. An electrostatic latent image corresponding to the output of the electronic computer is formed on the drum 1. This electrostatic latent image is developed by a developing device 8 of the magnet brush type or the like and with the aid of heat-fusible coloring particles, namely, toner, charged to the polarity opposite to or the same as the charge from the charger 2. The developed image, namely, the toner image, is transferred onto a transfer web 11 with charge of the opposite polarity from the toner being imparted from the corona discharger 9 to the back side of the transfer web 11. After the image transfer has been effected, any residual toner on the drum 1 is cleaned by a cleaning device 10.

In FIG. 1, the transfer web 11 is shown as a long footage of folded continuous paper, but alternatively it may be a roll of paper. The transfer web 11 is paid away from an untreated paper containing portion 11' by a set of feed rollers 12 and fed in the direction of arrow B at the same velocity as the peripheral velocity of the drum 1, whereby the transfer web 11 receives toner images transferred from the drum 1, as already described. The portion of the web 11 now bearing the toner images thereon is transported to a fixing device 15, by which the toner images on the web are subjected to fixation, and then the web is transported into a treated paper receiving portion 11'' by a set of transport rollers 16. Designated by 13 is a load means which comprises a flat plate or the like or sucking the back side of the web 11 with the aid of the action of a suction device 14 and for imparting to the web 11 a tension which tends to draw back the web from the fixing device 15. By the action of the load device 13, the web is brought under tension between the fixing device 15 and the load device 13.

At least, the photosensitive drum 1, charger 2, modulator 4, scanner 5, developing device 8, charger 9, feed rollers 12 and fixing device 15 perform their predetermined functions in synchronism with one another.

The load device 13 and transport rollers 16 may be normally in operation and in such case, the tension imparted to the web 11 by the transport rollers 16 is set to a value equal to or less than the tension imparted by the load device 13.

Figure 2:
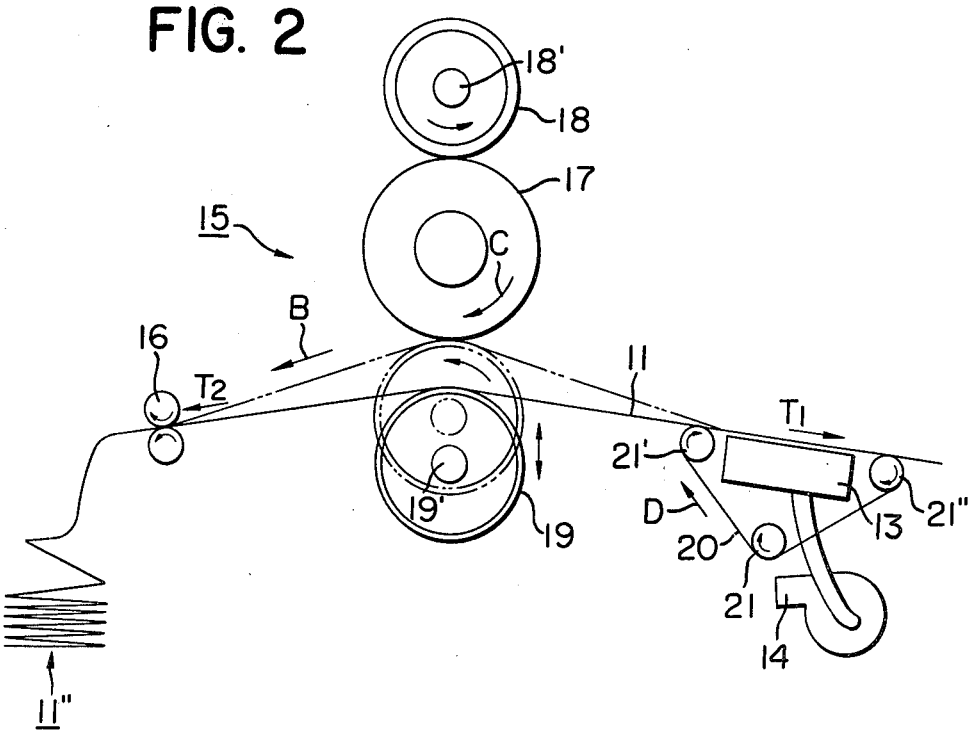
FIG. 2 illustrates an embodiment of the present invention.

FIG. 2 shows details of the fixing device 15 of FIG. 1. Denoted by 17 is a fixing roller which is rotatively driven in the direction of arrow C by an electric motor. The fixing roller 17 has a layer of silicone rubber on the peripheral surface thereof so as to prevent offset of toner images. At least the surface portion of the silicone rubber layer of the fixing roller 17 is heated to a temperature capable of fusing and fixing the toner, by a heat roller 18 having a heat source 18' therewithin and frictionally rotated in contact with the roller 17.

A pressure roller 19 is warmed up by a heat source 19' disposed therewithin. This roller warms up the web 11 to reduce the loss of heat from the fixing roller 17 to the web 11, thereby ensuring good fixation of toner images. The pressure roller 19 is displaceable between two predetermined positions, namely, the position indicated by solid lines and the position indicated by phantom lines. Thus, the roller 19 is reciprocally displaced in a direction normal to the peripheral surface of the fixing roller 17. When in the phantom-line position, the roller 19 urges the web 11 against the fixing roller 17. At that time, the web 11 is frictionally moved in the direction of arrow B following the rotation of the roller 17, whereby the toner images on the web 11 are fixed.

The movement of the web 11 also causes frictional rotation of the roller 19. The toner image bearing surface of the web 11 is urged against the fixing roller 17. When the fixation is being intermitted, the roller 19 is in its solid-line position. The web 11 is biased away from the fixing roller, normally or at least during its contact with the roller 17, such that the web 11 becomes spaced apart from the fixing roller 17 with the displacement of the roller 19 from its phantom-line position to its solid line position. This is accomplished by the suction load device 13 and the transport rollers 16. More specifically, the load device 13 and the rollers 16 impart tensions $T_1$ and $T_2$, respectively, to the web 11, and the resultant force of these tensions $T_1$ and $T_2$ is directed in a direction parallel or substantially parallel to the normal to the peripheral surface of the fixing roller 17 and away from the roller 17.

Thus, when the output from the electronic computer is to be printed, the pressure roller 19 is displaced to its phantom-line position to urge the web 11 against the fixing roller 17 and a predetermined length of the web 11 corresponding to the output is fed with rotation of the roller 17, whereafter fixation may be intermitted by displacing the pressure roller 19 to its solid-line position and spacing the web 11 apart from the fixing roller. When fixation is to be resumed, the pressure roller 19 is again displaced to its phantom-line position and another desired length of the web 11 is fed, whereafter fixation may be intermitted by returning the pressure roller 19 to its solid-line position. By repeating the above-described operation, the toner images on the web 11 from end to end may be fixed.

In the method shown in FIG. 2, the pressure roller 19 is reciprocally displaced in the direction normal to the peripheral surface of the roller 17, thereby bringing the toner image bearing surface of the web 11 into and out of contact with the fixing roller 17. Therefore, when the pressure roller 19 is displaced away from the fixing roller 17, some slack occurs in the web 11 between the suction load device 13 and the transport rollers 16. Such slack is eliminated by the roller 16 transporting the web 11 with a tension $T_2$ ($=T_1$). This, however, causes the boundary between the fixed portion and the unfixed portion of the toner image to pass between the rollers 17 and 19. When fixation is resumed, this would in turn result in an unfixed area formed on the web between the trailing end of the previously fixed portion and the starting end of the next fresh portion. To avoid this, the web 11 is drawn back in the direction opposite to the direction of transport by the roller 17, by the amount of said slack, namely, an amount corresponding to at least the difference between the length of the web in its phantom-line position and the length of the web in its solid-line position, as viewed in FIG. 2, immediately after the intermission of fixation or immediately before resumption of fixation, that is, during the intermission period of fixation. For this purpose, the suction force of the suction device 14 is increased to provide $T_1 > T_2$, and the endless porous belt 20 sucking the web 11 thereto is moved round in the direction of arrow D. After the web 11 has been drawn back by the aforementioned amount, the movement of the belt 20 is stopped and the suction force of the suction device 14 is reduced back to its low level, thus providing $T_1 = T_2$. The roller 16 is idly rotating so that the web 11 is not moved until it is subjected to the frictional transport force of the roller 17. The movement of the belt 20 is accomplished by a roller 21 driven from an electric motor and by auxiliary rollers 21' and 21''. Through the numerous pores formed in the belt 20, the action of the suction device 14 is imparted to the web 11 to suck and support the back side of the web 11 which is opposite from the toner image bearing surface.

If the pressure roller 19 is not displaceable or the web 11 is displaceable toward and away from the fixing roller 17 but the pressure roller 19 is stationary and the fixing roller 17 is displaceable toward and away from the web 11, then the aforementioned draw-back of the web is not always necessary. This is because no slack such as described above will occur in the web even if the fixing roller 17 becomes disengaged from the web 11. This alternative method is illustrated in FIG. 3.

Figure 3:
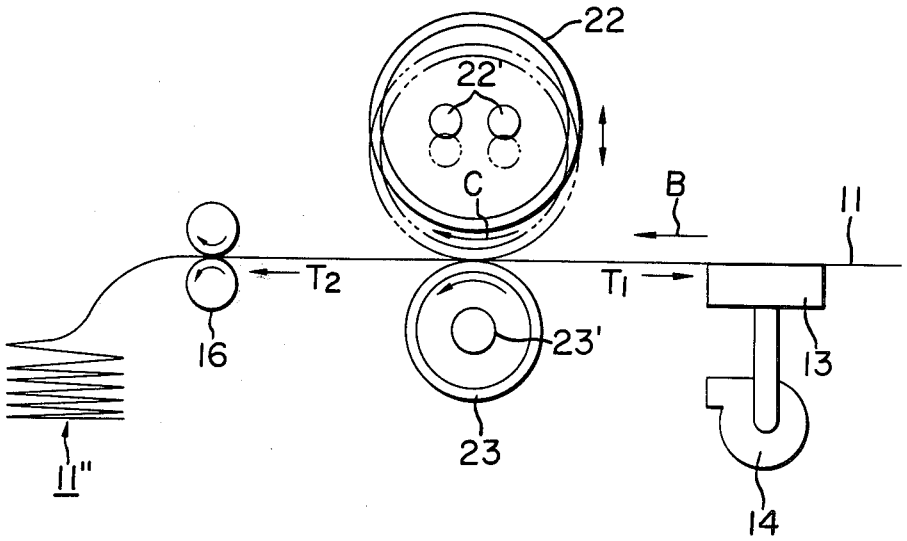
FIG. 3 illustrates another embodiment of the present invention.
Figure 4:
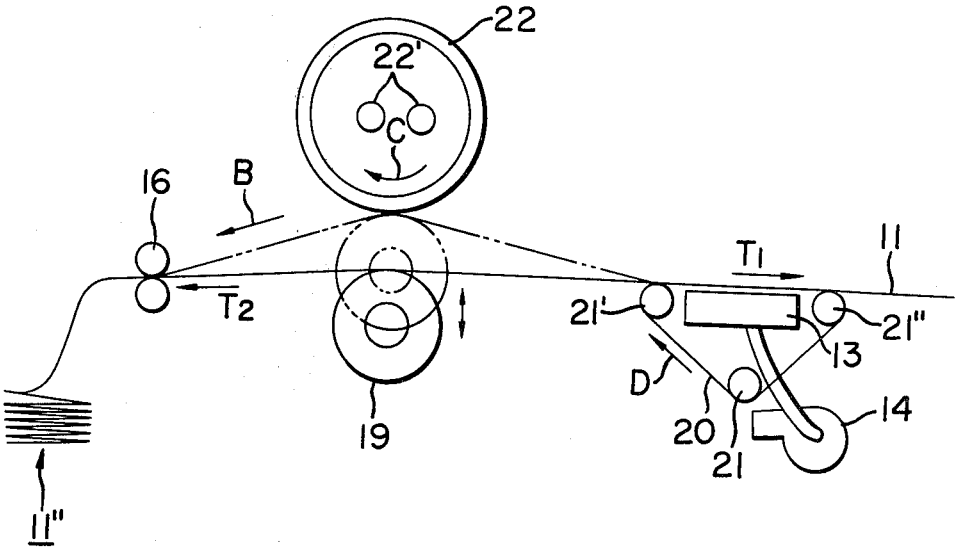
FIG. 4 illustrates still another embodiment of the present invention.

In contrast with the method of FIG. 2 wherein the fixing roller 17 is stationary and the pressure roller 19 is displaceable, the method of FIG. 3 is such that a pressure roller 23 having a warming heat source 23' therewithin is stationary and a fixing roller 22 is displaceable. The fixing roller 22 is displaceable between its solid-line position and its phantom-line position. In other words, the fixing roller 22 is reciprocally displaceable in the direction normal to the peripheral surface of the pressure roller 23, and when in the phantom-line position, the fixing roller 22 makes contact with the toner image bearing surface of the web 11. The fixing roller 22 is rotatively driven from an electric motor and frictionally moves the web 11 in the direction of arrow B, and as in the case of FIG. 2, the pressure roller 23 also frictionally follows the movement of the web to effect rotation. When the fixing roller 22 is displaced to its phantom-line position, fixation is started and during the intermission of fixation, the fixing roller 22 returns to its solid-line position. In accordance with the output from an electronic computer, the fixing roller 22 is displaced into or out of contact with the web 11 to repeat fixation of toner images over a desired length of the web, whereby the web 11 is duly treated from end to end. In FIG. 3, even when the fixing roller 22 is disengaged from the web 11, no slack will occur in the web 11 between the suction load device 13 and the transport rollers 16 and therefore, tensions $T_1$ and $T_2$ may always be equal to each other. However, as described in connection with FIG. 2, the roller 21 could be used to draw back the web 11 by a slight amount during the intermission of fixation. By doing so, it would be ensured for the fixing roller 22 to make contact with an already fixed toner image at the point of time for resuming fixation. In FIG. 3, the fixing roller 22 is shown as being heated by the heat source 22' disposed therewithin, whereas it may alternatively be a roller heated by a heating roller circumscribing therewith, as shown in FIG. 2, or a roller heated by extraneously applied infrared rays. Likewise, in the method of FIG. 2, the fixing roller 17 could be a roller heated by extraneously applied infrared rays or a roller having a heat source therewithin as shown in FIG. 3. An example of the latter is shown in FIG. 4. Again, in the method of FIG. 4, the process taking place is similar to what has been described with respect to FIG. 2, with the only exception that the heating by rollers 22' differs.

In the method described hitherto, if the fixing roller is being rotated both at the point of time whereat contact takes place between the web and the fixing roller and the point of time whereat separation takes place between the web and the fixing roller, there is a possibility of unsatisfactorily fixed image portions or disturbed image portions arising in the web. To avoid this, for the resumption of fixation, the web can be brought into contact with the fixing roller when stopped from rotating, and maintained in this state for a while, and/or for the intermission of fixation, the rotation of the fixing roller is first stopped and a little time after that, the web may be brought out of contact with the fixing roller. By doing so, sufficient heat for fixation can be imparted also to the toner image which is in contact with the fixing roller, at the moment when fixation is resumed and/or at the moment when fixation is intermitted. Hence, unfixed or half-fixed toner image will never be disturbed when it is contacted by or separated from the fixing roller.

Figure 5:
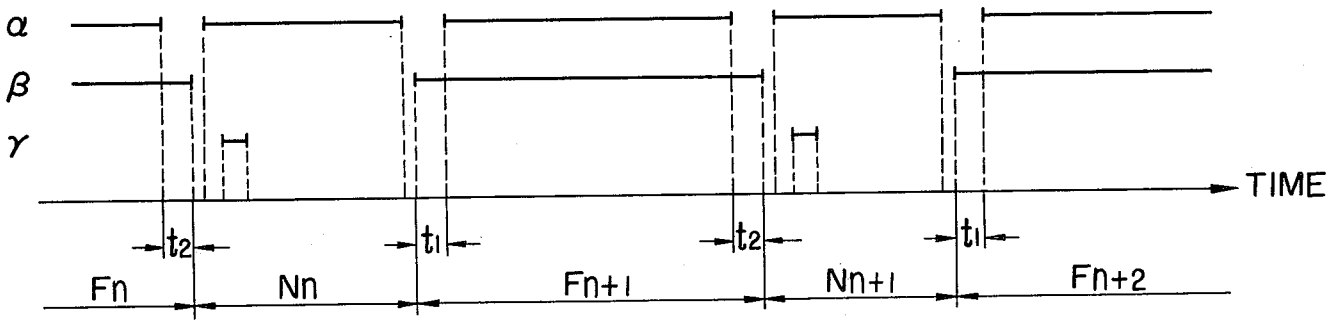
FIGS. 5 to 9 illustrate the time sequences in operation of the various embodiments, respectively, of the present invention.
Figure 6:
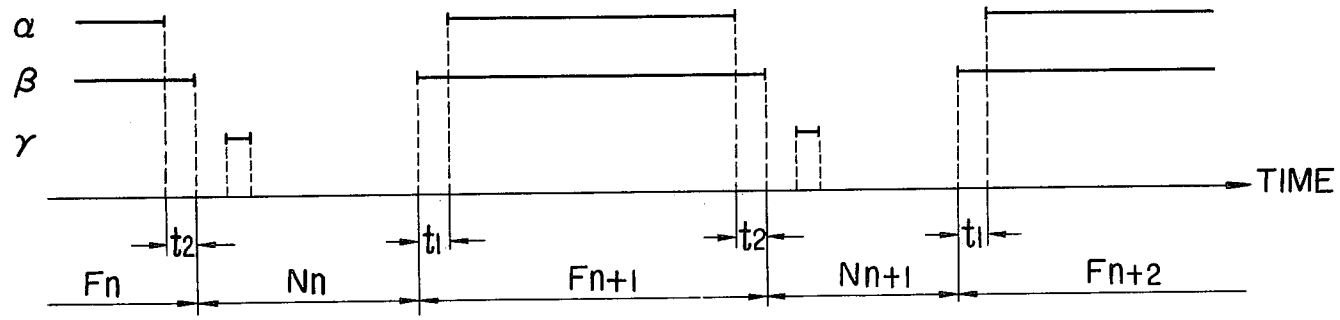

FIG. 5 illustrates the time sequence in which rotation of the fixing roller is temporally stopped both at the start of fixation and at the pause of fixation in the method of FIG. 2 and the web is drawn back by an amount corresponding to the aforementioned slack during the intermission of fixation. In FIG. 5, segment $\alpha$ represents the time during which the fixing roller 17 is rotating, segment $\beta$ represents the time during which the web 11 is in contact with the fixing roller 17, and segment $\gamma$ represents the time during which the output of the suction device 14 is increased and the belt 20 is moving round in the direction of arrow D. Section $F_N$ designates the time during which fixation is taking place, and section $N_N$ designates the time during which fixation is intermitted. The subscript N in $N_N$ is an integer and represents the Nth period of fixation or intermission since the treatment of the web was started from the first. Sections $t_1$ and $t_2$ represent the time during which the web 11 is in contact with the fixing roller when stopped from rotating. These times $t_1$ and $t_2$ are each set to a sufficient length for the toner image in contact with the non-rotating fixing roller to be fixed. Even during the fixation intermission section $N_N$, the fixing roller 17 is rotated to uniformly heat the heating roller 18 circumscribing therewith. If use is made of a roller having a heat source 22' therewithin, such as the fixing roller 22 shown in FIG. 4, then the fixing roller 17 may be stopped from rotating during the section $N_N$. This is illustrated in FIG. 6. Reference characters appearing there are similar in significance to those in FIG. 5.

Figure 7:
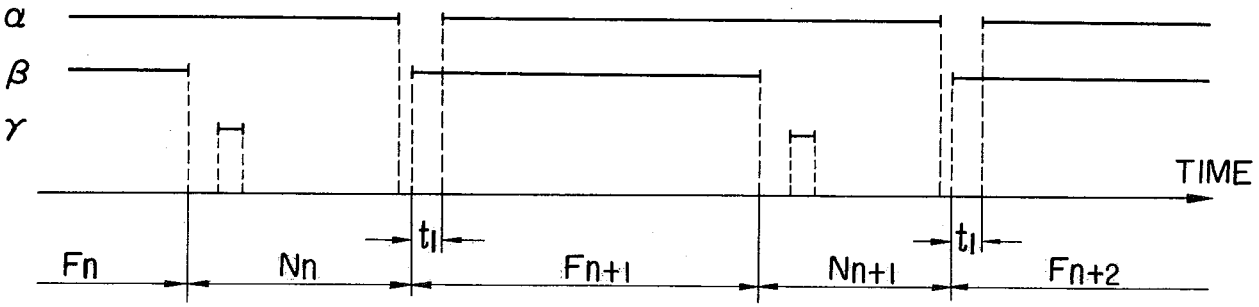
Figure 8:
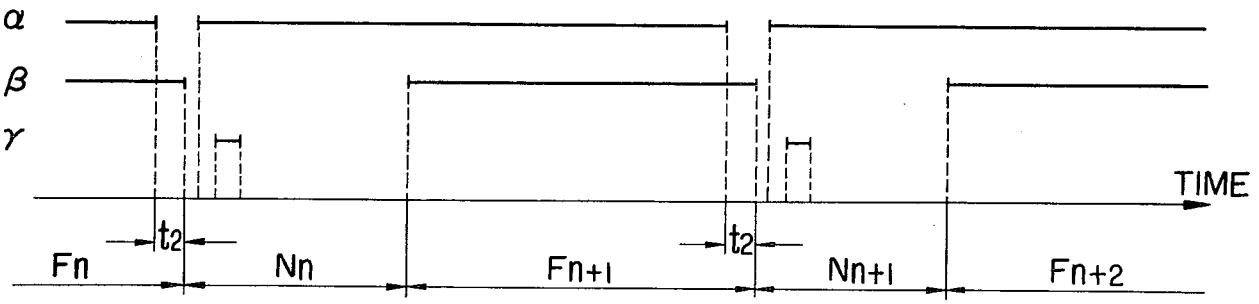
Figure 9:
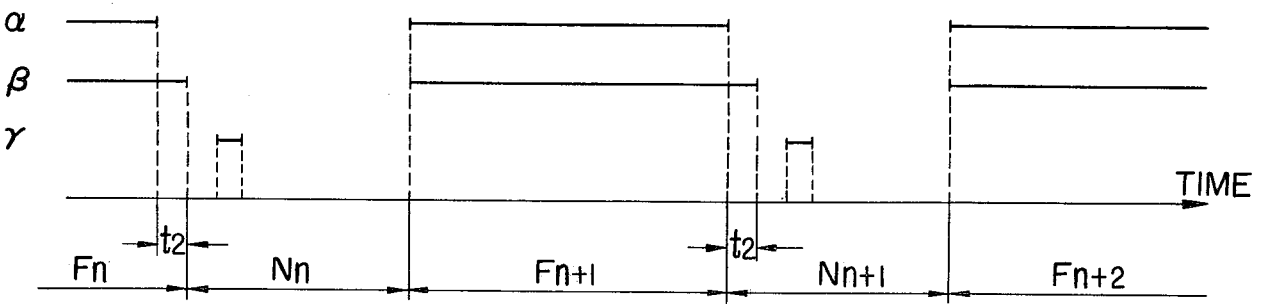

The manner in which the rotation of the fixing roller is temporally stopped only at the start of fixation in the method of FIG. 2 or 4 is illustrated in FIG. 7; the manner in which the rotation of the fixing roller is temporally stopped only at the pause of fixation in the method of FIG. 2 or 4 is illustrated in FIG. 8; and the manner in which the pressure contact of the web with the fixing roller stopped only during the intermission of fixation in the method of FIG. 4 is maintained for a predetermined time and the manner in which the rotation of the fixing roller is stopped during the intermission period of fixation are shown in FIG. 9. In FIG. 9, the starting end of each segment $\alpha$, namely, the point of time whereat the web is urged against the fixing roller. Reference characters in FIGS. 7, 8 and 9 are similar in significance to those in FIG. 5.

In the method of FIG. 7, that portion of toner image which was in contact with the fixing roller during the intermission of fixation fails to be sufficiently fixed but, when another fixation is resumed, such portion of toner image makes contact with the fixing roller now stopped from rotating and maintains such state for a predetermined time, whereby sufficient fixation is accomplished. In the method of FIG. 8 or 9, toner image is urged against the rotating fixing roller when fixation is resumed, but that toner image has already been fixed sufficiently by having for a predetermined time been in contact with the fixing roller which was stopped from rotating at the end of the previous fixing cycle. Therefore, the methods of FIGS. 7, 8 and 9, like the methods of FIGS. 5 and 6, can uniformly fix the toner images carried on a long footage of web from end to end.

Any of the methods shown in FIGS. 5 to 9 is also applicable to the embodiment of FIG. 3 in which the fixing roller is displaceable into and out of contact with the web. In such case, the web may always be under tension and thus, the aforementioned step of drawing back the web by a predetermined amount during the segment $\gamma$ shown in FIGS. 5 to 9, namely, during the intermission period of fixation is not always necessary. Of course, as by using the porous belt 20 and roller 21 of FIG. 2 with the method of FIG. 3, it is also possible to slightly draw back the web during the intermission period of fixation as shown in FIGS. 5 to 9. By doing so, uniform fixation may be obtained with much higher reliability, although the operation would become more or less complicated.

Figure 10:
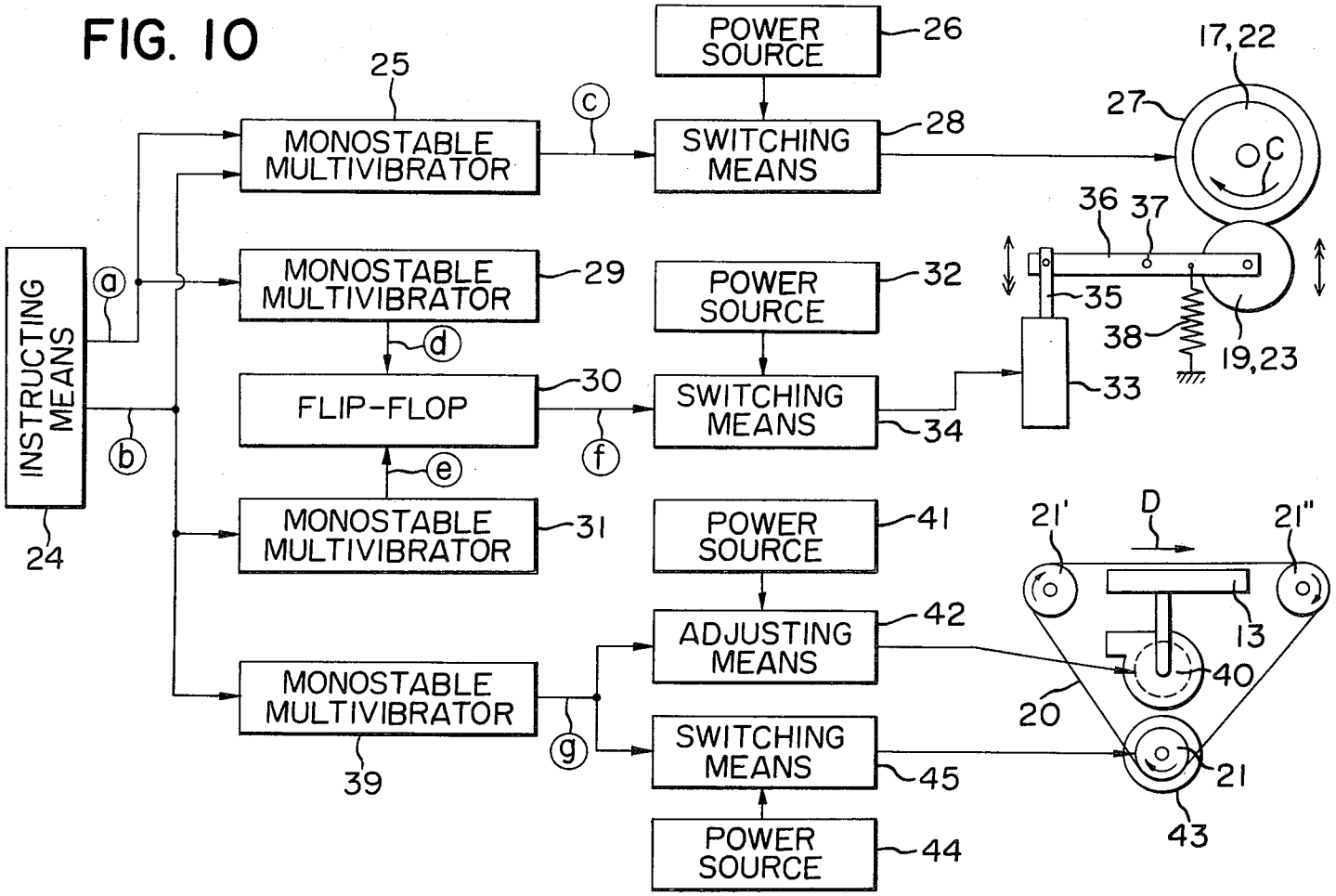
FIG. 10 is a block diagram of the control system for carrying out an embodiment of the present invention.
Figure 11:
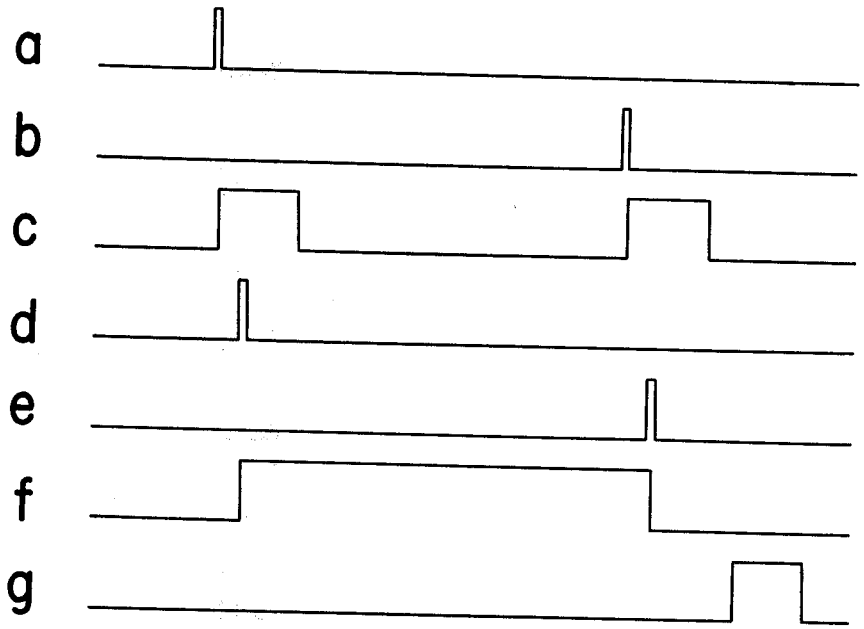
FIG. 11 shows signals appearing at various portions of FIG. 10.

FIG. 10 is a block diagram showing a control mechanism whereby the method of FIG. 5 is applicable to the method of FIG. 2, and FIG. 11 illustrates waveforms of the signals appearing at various portions of the FIG. 10 apparatus.

Designated by 24 is a conventional instructing means for instructing print-out of output in accordance with the output from an electronic computer, and this instructing means generates start signal ⓐ and stop signal ⓑ both of which are short pulses. The signals ⓐ and ⓑ are applied to a monostable multivibrator 25, which in turn generates rectangular wave signal ⓒ which continues for a time T from the application of signal ⓐ or ⓑ (time T being slightly longer than the time $t_1$ or $t_2$ in FIGS. 5 to 9). The signal ⓒ is applied to a conventional switching means 28 interposed between a power source 26 and a motor 27 for rotatively driving the fixing roller 17 or 22, and this switching means 28 stops the power supply to the motor 27 as long as the signal ⓒ is present.

The start signal ⓐ is also applied to a conventional monostable multivibrator 29. This monostable multivibrator 29 generates a short pulse signal ⓓ in a time $(T-t_1)$ after reception of the signal ⓐ . The signal ⓓ applied to a conventional bistable multivibrator 30. This bistable multivibrator may also receive signal ⓔ from a conventional monostable multivibrator 31. The monostable multivibrator 31, to which the stop signal ⓑ is applied, generates a short pulse signal ⓔ in a time $(T-t_2)$ after reception of the signal ⓑ . Thus, the bistable multivibrator 30 generates a rectangular wave signal ⓕ which continues from reception of the signal ⓓ till reception of the signal ⓔ. The signal ⓕ is applied to a conventional switching means 34 interposed between a power source 32 and a reciprocating solenoid 33, and the switching means 34 permits the power supply to the solenoid 33 as long as the signal ⓕ is present.

The solenoid 33, when electrically energized, is operative to attract a shaft 35 and, when electrically deenergized, it liberates the shaft 35. The shaft 35 is pivotally connected to one end of a lever 36 rockable about a pivot 37, and the pressure roller 19 or 23 is rotatably mounted on the other end of the lever 36. Designated by 38 is a tension spring for biasing the lever 36 in the direction in which the pressure roller 19 or 23 is retracted away from the fixing roller 27. Thus, when the solenoid 33 attracts the shaft 35, the web is urged against the fixing roller by the pressure roller, and when the solenoid 33 liberates the shaft 35, the web is brought out of contact with the fixing roller.

The stop signal ⓑ is further applied to a conventional monostable multivibrator 39. This monostable multivibrator generates a rectangular wave signal ⓖ which continues for a time corresponding to the duration of the segment $\gamma$ in FIGS. 5 to 9, in at least the time $t_2$, preferably the time T or longer, after reception of the signal ⓑ and sufficiently before the subsequent fixation is started. The signal ⓖ is applied to a conventional output adjusting means 42 interposed between a motor 40 for driving the suction device 14 and a power source 41, and to conventional switching means 45 interposed between a motor 43 for rotatively driving the roller 21 which frictionally moves the belt 20 and a power source 44. The adjusting means 42 increases the output of the motor 40 as long as the signal ⓖ is present, and the switching means 45 permits the power supply to the motor 43 as long as the signal ⓖ is present. By this, the web is drawn back by the predetermined amount, as already noted.

In the method wherein the fixing roller is displaceable between two positions to thereby bring about its engagement and disengagement with the web, the fixing roller may be mounted to the lever 36 of FIG. 10. In the case as shown in FIG. 2 wherein a heating roller is used to heat the fixing roller, the fixing roller and the heating roller may be mounted on a common support member, which may in turn be mounted to the lever 36. In any case, the monostable multivibrator 39 of FIG. 10 is not always necessary in the method wherein the fixing roller is displaced. This is because the web can also be moved always without being slackened.

To realize the method of FIG. 7, such a design should be made in FIG. 10 that only the start signal ⓐ is applied to the monostable multivibrator 25. To realize the method of FIG. 8, such a design should be made in FIG. 10 that only the stop signal ⓑ is applied to the monostable multivibrator 25.

Figure 13:
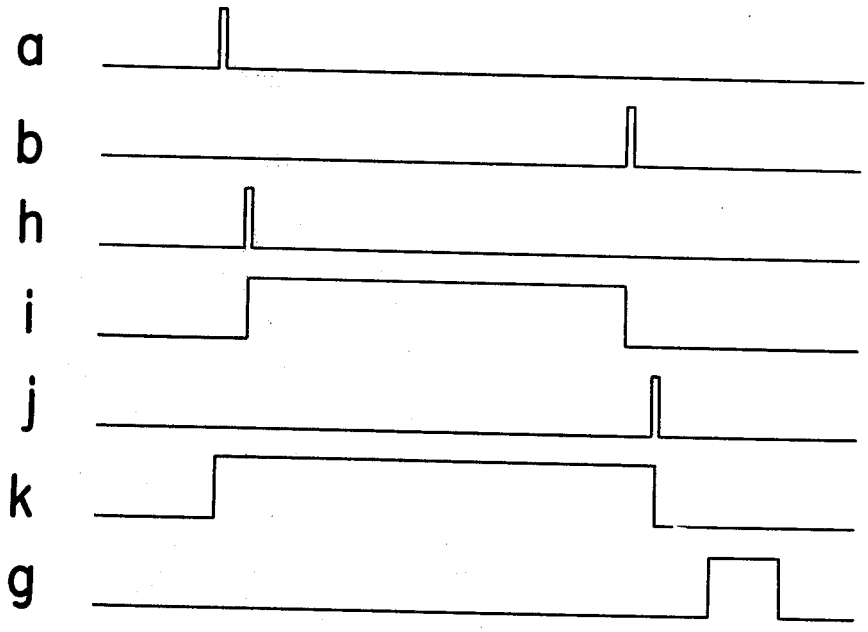
FIG. 13 shows signals appearing at various portions of FIG. 12.
Figure 12:
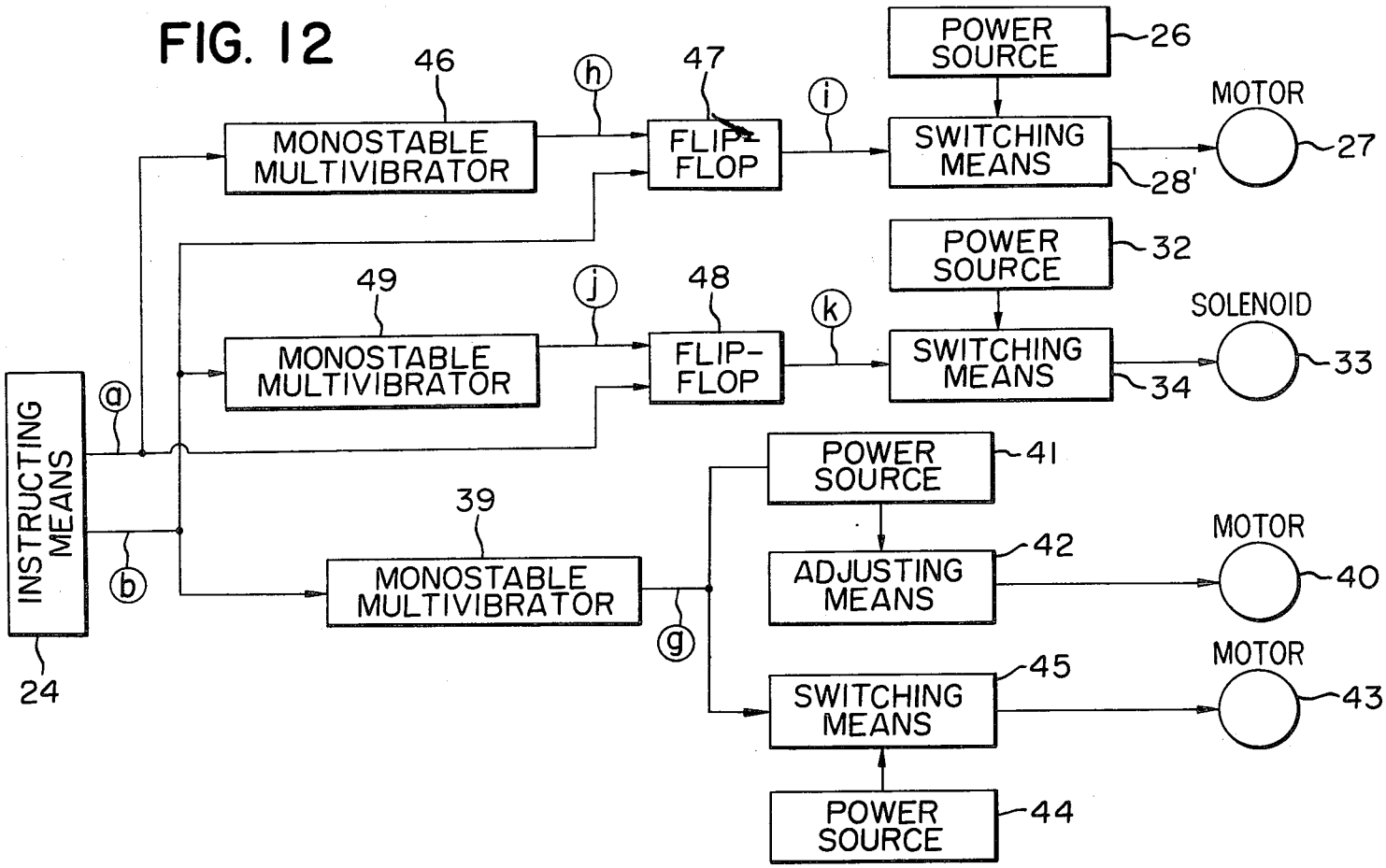
FIG. 12 is a block diagram of the control system for carrying out another embodiment of the present invention.

FIG. 12 shows, in block diagram, the control mechanism for carrying out the method of FIG. 6. FIG. 13 illustrates the waveforms of signals appearing at various portions of FIG. 12.

The start signal ⓐ from instructing means 24 is applied to a conventional monostable multivibrator 46, which generates a short pulse signal ⓗ in the time $t_1$ after reception of the signal ⓐ of FIG. 6. The signal ⓗ is applied to a conventional bistable multivibrator 47. The stop signal ⓑ from the instructing means 24 is also applied to this bistable multivibrator 47. Thus, the bistable multivibrator 47 generates a rectangular wave signal ⓘ which continues from reception of the signal ⓗ till reception of the signal ⓑ.

A conventional switching means 28' applies the power from the power source 26 to the fixing roller driving motor 27 as long as the signal ⓘ is present.

The start signal ⓐ is applied to a conventional bistable multivibrator 48. The bistable multivibrator 48 also receives a signal ⓙ generated by a conventional monostable multivibrator 49 to which the stop signal ⓑ is applied, and it generates a rectangular wave signal ⓚ which continues from reception of the signal ⓐ till the reception of signal ⓙ. The signal ⓙ generated by the monostable multivibrator 49 is a short pulse which is formed in the time $t_2$ of FIG. 6 after reception of the signal ⓑ. The switching means 34 operates the solenoid 33 to attract the shaft 35 (see FIG. 10) as long as the signal ⓚ is present. The stop signal ⓑ is applied to the monostable multivibrator 39, as in the case of FIG. 10, and this monostable multivibrator 39 generates a rectangular wave signal ⓖ, which continues for a time corresponding to the duration of the segment $\gamma$, in at least the time $t_2$ after reception of the signal ⓑ and sufficiently before the subsequent fixation is resumed. In the other points, the mechanism of FIG. 12 is similar to that of FIG. 10.

In order for the method of FIG. 9 to be carried out, the monostable multivibrator 46 in FIG. 12 can be eliminated such that the signal ⓐ, instead of the signal ⓗ, is applied to the bistable multivibrator 47.

In the method wherein the fixing roller, instead of the pressure roller, is displaced by the solenoid 33, the system subsequent to the monostable multivibrator 39 is not always necessary, as already described. This is because the web can also be maintained always under tension.

The present invention is applicable not only for printing out the output from an electronic computer, but also to any process such as copying, electrostatic printing or the like in which toner images are formed on a long footage of continuous web and fixed intermittently.

What we claim is:

1. A method of intermittently fixing a toner image formed on a web by intermittently transporting the web to a heated fixing roller for heat fusing the toner image, wherein the fixing roller contacts and is disengaged from the toner image bearing surface of the web, said method comprising the steps of:

rotating the fixing roller, while contacting the web, to transport the web and fix the toner image thereon;

disengaging the fixing roller and the web from each other, to interrupt the fixing action of the fixing roller, after a desired amount of the web has been transported;

again contacting the fixing roller and the web with each other, to resume the fixing action, after a desired interruption period has elapsed;

stopping the rotation of the roller at the time of or before the time when the roller and the web are again contacted with each other; and resuming the rotation of the fixing roller, to transport the web, a predetermined time after the roller and the web are again contacted with each other;

whereby a toner image is not disturbed when contacted with the fixing roller.

2. A method according to claim 1, wherein the roller is stopped before the roller and the web are again contacted with each other.

3. A method according to claim 1, wherein the fixing roller is stopped substantially at the same time as the roller and the web are again contacted with each other.

4. A method according to claim 1, further comprising the step of drawing back the web by a predetermined amount while the web is out of contact with the fixing roller.

5. A method of intermittently fixing a toner image formed on a web by intermittently transporting the web to a heated fixing roller for heat fusing the toner image, wherein the fixing roller contacts and is disengaged from the toner image bearing surface of the web, said method comprising the steps of:

rotating the fixing roller, while contacting the web, to transport the web and fix the toner image thereon;

stopping the rotation of the fixing roller with the web maintained in contact with the fixing roller, after a desired amount of web has been transported;

disengaging the roller and the web from each other, to interrupt the fixing action of the fixing roller, a predetermined time after the rotation of the fixing roller has been stopped; and again contacting the fixing roller and the web with each other, to resume the fixing action, after a desired interruption period has elapsed;

whereby the toner image is sufficiently fixed prior to separation to prevent disturbance.

6. A method according to claim 5, further comprising the step of drawing back the web by a predetermined amount while the web is out of contact with the fixing roller.

7. A method of intermittently fixing a toner image formed on a web by intermittently transporting the web to a heated fixing roller for heat-fusing the toner image, wherein the fixing roller contacts and is disengaged from the toner image bearing surface of the web, said method comprising the steps of:

rotating the fixing roller, while contacting the web, to transport the web and fix the toner image thereon;

stopping the rotation of the fixing roller with the web maintained in contact with the fixing roller, after a desired amount of the web has been transported;

disengaging the fixing roller and the web from each other, to interrupt the fixing action, a first predetermined time after the rotation of the fixing roller has stopped;

again contacting the fixing roller and the web with each other, to resume the fixing action, after a desired interruption period has elapsed; and then resuming the rotation of the fixing roller, to transport the web, a second predetermined time after the fixing roller and the web are again contacted with each other;

whereby a toner image is not disturbed when contacted with and separated from the fixing roller.

8. A method according to claim 7, further comprising the steps of rotating the fixing roller after the fixing roller and the web have been disengaged from each other, and stopping the rotation of the fixing roller before the fixing roller and the web are again contacted with each other.

9. A method according to claim 7, wherein the fixing roller is kept stopped throughout the interruption period.

10. A method according to claim 7, further comprising the step of drawing back the web by a predetermined amount while the web is out of contact with the fixing roller.

* * * * *